United States Patent [19]

Sexton et al.

[11] 4,181,302

[45] Jan. 1, 1980

[54] HALF BALL GAME

[76] Inventors: Carl E. Sexton, c/o George Spector, 3615 Woolworth Bldg., 233 Broadway; George Spector, 3615 Woolworth Bldg., 233 Broadway, both of New York, N.Y. 10007

[21] Appl. No.: 769,320

[22] Filed: Feb. 17, 1977

[51] Int. Cl.[2] ..... A63B 67/00; A63B 37/10

[52] U.S. Cl. ..... 273/95 R; 273/95 H; 273/106 R; 273/58 R; 273/DIG. 20

[58] Field of Search ..... 273/95 R, 95 H, 106 R, 273/128 R, 25, 58 R, 59 B, 60 R, 63 E, 90, DIG. 20

[56] References Cited

U.S. PATENT DOCUMENTS

| | | | |
|---|---|---|---|
| 1,050,835 | 1/1913 | Jensen | 273/128 R |
| 2,504,650 | 4/1950 | Chessrown | 273/58 B X |
| 2,524,546 | 10/1950 | Sinclaire | 273/106 R X |
| 2,683,603 | 7/1954 | Gackenbach | 273/106 R |
| 3,099,450 | 7/1963 | Randall | 273/106 R |
| 3,508,747 | 4/1970 | Orsatti | 273/25 |

*Primary Examiner*—William H. Grieb

[57] ABSTRACT

A kit of a novel design of baseball game equipment, and which includes two hemispherical rubber balls, a stick-like bat and four brick-shaped, plastic base markers which are laid out spaced apart in a straight line for being run by a batter after having batted one of the half balls.

1 Claim, 5 Drawing Figures

Fig. 1
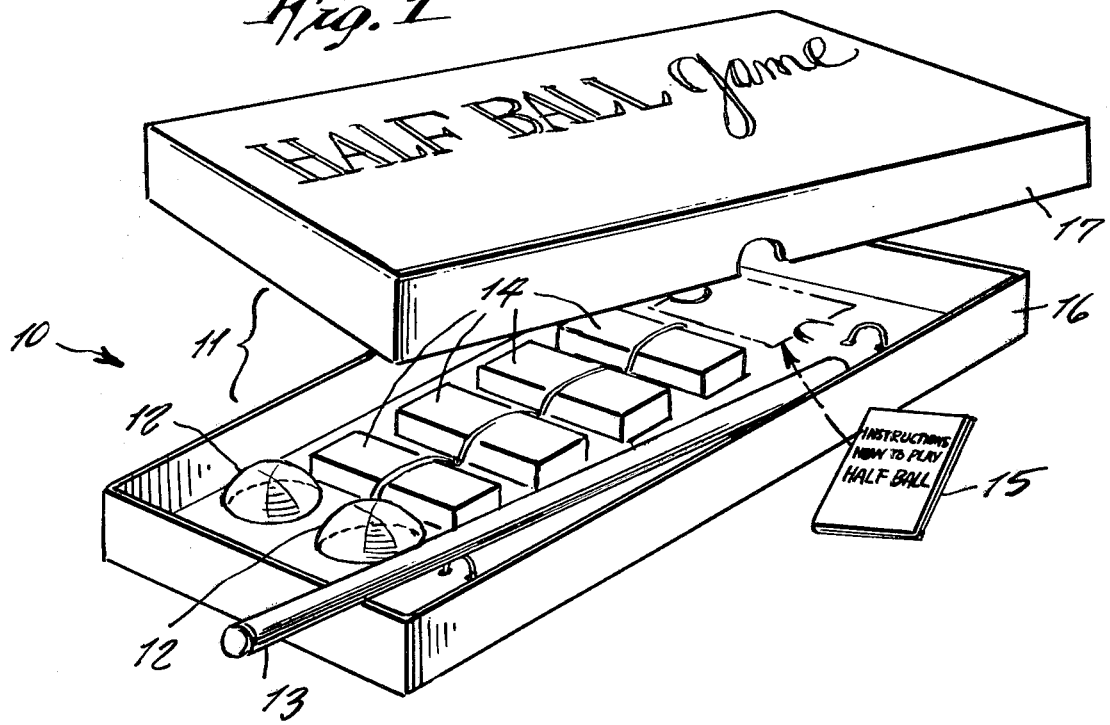
Fig. 2
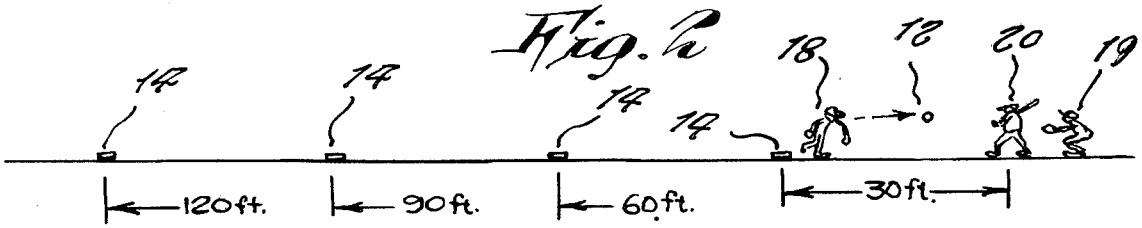
Fig. 3
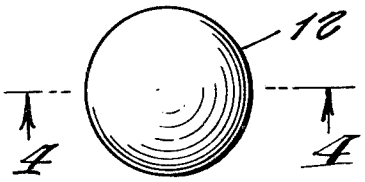
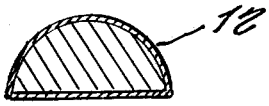
Fig. 4
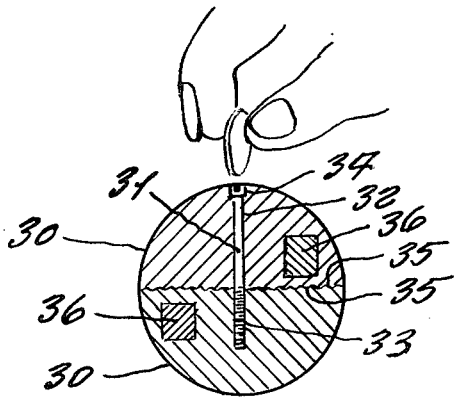
Fig. 5

HALF BALL GAME

This invention relates generally to baseball games and baseball equipment.

A principal object of the present invention is to provide a new design of baseball equipment which, instead of employing spherical balls, uses hemispherical balls that are batted.

Another object is to provide a half ball game in which the playing equipment is made up in a packaged kit for being retailed, and which includes two half balls, a batting stick, and four brick-shaped plastic bases together with an instruction book of how to play the game.

Yet another object is to provide a half ball game in which the game bases are not laid out in a conventional diamond shape, but in a straight line.

Other objects are to provide a half ball game which is simple in design, inexpensive to manufacture, rugged in construction, easy to use and efficient in operation.

These and other objects will be readily evident upon a study of the following specification and the accompanying drawing, wherein:

FIG. 1 is a perspective view of the half ball game shown as a kit for being retailed to a consumer.

FIG. 2 is a side view of the game set up with the base markers placed in a row.

FIG. 3 is a top view of one of the half balls.

FIG. 4 is a cross-section on line 4—4 of FIG. 3.

FIG. 5 is a cross-section of a modified design wherein the half-balls can be attached together if wished so to form one whole ball, and each half ball has a weight inside one end thereof which can be selectively made either diametrically apart or brought closer together so to cause the ball to fly eccentrically when pitched and thus make it more challanging for a batter to hit it.

Referring now to the drawing in greater detail, and more particularly to FIGS. 1 through 5 thereof, a half ball game kit according to the present invention, which includes a cardboard box 11 containing two half balls 12, a batting stick 13, four base markers 14 and an instruction book 15 for playing the game.

The box is comprised of a case 16 and cover 17 and measures 18 inches wide and 40 inches long.

The half balls are made of solid, medium hard rubber and measure 2½ inches in diameter.

The batting stick comprises a hard wood stick that measures 38 inches long and which is one inch in diameter throughout its enire length.

The base markers are each made of either plastic or wood and measure 3 by 12 inches in width and length.

The game can be played by adults or children or by both, and includes four players divided into two teams of two players each, so that each team can include a pitcher 18 and a catcher 19, while the other team players each in turn becomes a batter 20.

In the game, the base markers are laid out in a straight line, the markers being spaced equidistant 30 feet apart and a first marker being 30 feet from the position of the batter. Alternately, these distances may be made closer together or further apart, or at dis-similar distances apart. The batter scores a single by hitting the half ball over the 30 foot marker, a double by hitting the half ball over the 60 foot marker, a triple over the 90 foot marker, and a home run over the 120 foot marker. The scoring is thereafter similar to conventional baseball.

All the equipment may be brightly colored in various colors so to be attractive and easily seen. The half ball may be made, if preferred, with a skin that is of a different hardness than a core thereof, as suggested in FIG. 4.

In FIG. 5, a modified design of half balls 30 is shown which are selectively attachable together so that they can be used either as two hemispherical half balls, or else as a single spherical ball, as wished. The half balls are attachable together by a single centrally axial screw 31 that is passed through a clearance hole 32 in one half ball and into a threaded hole 33 of the other half ball. The screw includes an enlarged head 34 that is below an outer contoured surface of the ball, and includes a cross slot that can be engaged by a coin or any other handy object that may be in a player's pocket so that no screw driver needs to be carried. Each ball has a roughened flat face 35 for frictional hold against rotation respective to each other.

Each half ball may be additionally made to be eccentrically balanced by having a heavy metal weight 36 embedded in an eccentric location in the ball. By positioning the weights closest together when assembling the ball, the ball is thus at maximum eccentric balance for throwing a curved ball or a ball on a winding path, thus requiring greater skill for being batted. By positioning the weights farther apart the eccentric force is less, and as shown in FIG. 5 are at a minimum.

While various changes may be made in the detail construction, it is understood that such changes will be within the spirit and scope of the present invention, as is defined by the appended claims.

What is claimed is:

1. A game comprising a pair of hemispheric batting projectiles having matching flat surfaces including means for securing said members together to form a ball, in combination with a batting stick and markers to indicate varying distances from a batting position, whereby said projectiles can be used individually and also secured together as a batting projectile, wherein each said projectile includes a weight adjustably positioned relative to each other when secured together to provide a ball of variable weight distribution, wherein said projectiles are secured together by an axial member rotatably extending through one of said projectiles and threadedly engaging the other of said projectiles whereby said projectiles are relatively rotatable for varying the weight distribution of the assembled ball.

* * * * *